United States Patent [19]

Falgout, Sr. et al.

[11] Patent Number: 4,811,798

[45] Date of Patent: Mar. 14, 1989

[54] DRILLING MOTOR DEVIATION TOOL

[75] Inventors: Thomas E. Falgout, Sr., Youngsville; William N. Schoeffler, Lafayette, both of La.

[73] Assignee: Team Construction and Fabrication, Inc., Youngsville, La.

[21] Appl. No.: 924,908

[22] Filed: Oct. 30, 1986

[51] Int. Cl.[4] ..... E21B 17/10

[52] U.S. Cl. ..... 175/73; 175/256

[58] Field of Search ..... 175/61, 73, 76, 92, 175/107, 232, 256, 320

[56] References Cited

U.S. PATENT DOCUMENTS

| | | | |
|---|---|---|---|
| 2,402,238 | 6/1946 | Carpenter | 175/256 |
| 2,680,005 | 6/1954 | Storm | 175/256 |
| 3,068,946 | 12/1962 | Frisby et al. | 175/256 |
| 3,131,778 | 5/1964 | Emerson et al. | 175/256 |
| 3,717,208 | 2/1973 | Anderson | 175/256 |
| 3,961,674 | 6/1976 | Craig, Jr. et al. | 175/76 |
| 4,394,881 | 7/1983 | Shirley | 166/319 |
| 4,442,908 | 4/1984 | Steenbock | 175/73 |
| 4,655,289 | 4/1987 | Schoeffler | 166/320 |

FOREIGN PATENT DOCUMENTS

| | | | |
|---|---|---|---|
| 1182169 | 11/1964 | Fed. Rep. of Germany | 175/325 |
| 969881 | 4/1981 | U.S.S.R. . | |

*Primary Examiner*—Stephen J. Novosad
*Assistant Examiner*—William P. Neuder
*Attorney, Agent, or Firm*—John D. Jeter

[57] ABSTRACT

A body and driveshaft extension for down hole drilling motors to allow the down hole assembly to operate as part of a drill string responsive to selected manipulations of the drilling fluid flow rate, carried out at the earth surface, to assume either a straight hole drilling configuration or a directional drilling configuration by choice of the driller.

In the directional drilling configuration, the drill head driving output shaft rotates about a centerline deflected from the motor general centerline. The point of deflection is between the drilling motor and the drill head.

21 Claims, 4 Drawing Sheets

DRILLING MOTOR DEVIATION TOOL

This invention pertains to the use of down hole well drilling motors, including positive displacement motors, turbodrill motors and electrodrill motors to accomplish either straight hole drilling or directional drilling, selectively, with the same down hole assembly. More particularly, the present invention pertains to means, controllable at the earth surface, by manipulation of the drilling fluid flow controls, to cause the down hole assembly to assume a straight hole drilling configuration or a directional drilling configuration as selected by the driller.

Apparatus of this invention utilizes, as a sub-assembly, the apparatus of the copending U. S. patent application Ser. No. 784,262 filed Oct. 4, 1986. By reference, that application is made part of this specification. The sub-assembly is referred to herein as a Remote Control Selector (RCS) valve.

BACKGROUND

The need to change the down hole assembly of a drill string by actions carried out at the earth surface, to selectively drill a straight or directional hole, has long been recognized. The conventional practice of round-tripping the drill string to change the bottom hole assembly is costly in rig time and wear and tear on all machinery involved. The round-tripping is still a common practice although some progress has been made with development of alternate procedures and those known will be described.

The earliest known practice involved the use of a bendable sub used just above a drilling motor and held straight for straight hole drilling by a spear dropped down the drill string bore. The spear could be recovered by a wire line down the drill string bore and, in it's absence, a hydraulic cylinder responsive to drilling fluid flow would cause a knuckle joint in the bendable sub to deflect the centerline of the drilling motor. That sub was usable only above a drilling motor and long powerful drilling motors were hard to effectively deflect from a point so far above the drill head. Such apparatus would not work on the motor output shaft.

U.S. Pat. No. 4,319,649, issued Mar. 16, 1982, disclosed an eccentric stabilizer to be attached, preferably, at the lower end of a drilling motor housing. The stabilizer was capable of about 180 degrees of rotation relative to the motor housing. When the drill string was rotated to the right, for drilling, the stabilizer was concentric with the motor centerline. When the drill string was rotated to the left, the stabilizer would rotate to be eccentric. With drilling fluid flowing, the stabilizer would be locked eccentric and could be oriented by the drill string for controlled deflection of the proceeding hole. By stopping fluid flow and again rotating the drill string to the right, the stabilizer would again become concentric and straight hole drilling could proceed.

A drilling practice now in use involves an eccentric stabilizer welded to the drilling motor body near the lower end. For directional drilling, the drill string is oriented by conventional processes and drilling proceeds. To drill straight hole, the drill string, eccentric stabilizer and all, is rotated. This system strains the downhole assembly and is usually employed only above poly-crystalline diamond bits that do not demand geometric symmetry with the axis of rotation.

U.S Pat. No. 2,345,766 issued Apr. 4, 1944 and 2,375,313 issued May 8, 1945, by the same inventor, discloses apparatus responsive to drilling fluid flow to deflect the centerline of a pilot bit before the drill string rotation takes place. The drill string is lowered to place the deflected pilot drill head, which is moved laterally by drilling fluid flow, against the borehole wall. Drill string rotation then drills ahead and the drill string and full gage bit follows through the newly deflected hole. These were rotary drilling devices and were not known to be used, or usable, on drilling motors.

Russian publication 969,881 of 10/30/1982, in *Drilling Technology* discloses apparatus usable on drilling motors to skew the axis of rotation of the drill head driving output shaft relative to the motor body. The actuator that forces the axis to be skewed is responsive to drilling fluid flow but responds every time drilling fluid is caused to flow. No drilling can be done with the output shaft axis straight relative to the motor. The actuator force means and the gimbal that allows the force to skew the axis of the output shaft are quite similar in iunction to those aspects of the present invention. There are some differences in structure. The present invention distinguishes over the cited Russian system by the use of a remote control selector valve to control the skewing action. A skewed axis is the same as a deflected axis if the machine element deflected rotates on the deflected axis. The present invention permits the output shaft to, selectively, remain straight relative to the motor body while drilling fluid flows. The Russian apparatus can have a straight overall centerline only when the drilling motor is idle, primarily to ease transport of the down hole assembly along the well bore during round-tripping the drill string.

Efforts to allow down hole drilling assemblies, with and without down hole motors, to be used selectively for directional work and straight hole drilling has persisted for many years. No products are known to have evolved that permit drilling fluid flow controls to be used at the earth surface to select the drilling mode to be carried out down hole.

It is therefore an object of this invention to provide apparatus to change a down hole drilling assembly to select straight hole or directional drilling configuration by selectively actuating drilling fluid flow controls at the earth surface.

It is another object of this invention to provide an assembly to be attached, as an extension, to an existing down hole motor adapted to connect to the extension, to provide the motor with the ability to respond to drilling fluid flow controls, exercised at the earth surface, to either deflect the drilling axis or to hold it straight for drilling.

It is another object of this invention to provide a down hole drilling motor, adapted with an output shaft directional controling extension, with a proven remote control selector valve, situated in the extension, to respond to exercises of drilling fluid flow controls at the earth surface to deflect the output shaft from normal drilling to directional drilling.

These and other objects, advantages, and features of this invention will be apparent to those skilled in the art from a consideration of this specification, including the attached drawings and appended claims.

SUMMARY OF THE INVENTION

An extension assembly is provided for any known form of down hole drilling motor, adapted to fit the extension, to control the deflection of the rotational axis of the final output shaft relative to the rotational axis of the motor.

A hinge means is secured in the extension body to permit changing the deflection angle of the output shaft which rotates through bearings in the hinge means.

The driveshaft of the extension has two universal joints, one near the attached motor and one near the hinge means. Between the universal joints, the extension driveshaft has means responsive to drilling fluid flow manipulations to force the driveshaft midsection laterally relative to the extension body. The extension body is rigidly attached to the motor body and effectively becomes part of the drill string.

The forced lateral position of the driveshaft midsection operates, in conjunction with the hinge means, to cause the output shaft to rotate about an axis that crosses the motor rotational axis at the hinge point.

In the extension driveshaft, through which drilling fluid flows, a remote control selector valve is situated. The valve responds to fluid flow manipulations of a first characteristic to cause the output shaft to be straight and responds to fluid flow manipulations of a second characteristic to cause the output shaft to be deflected.

DETAILED DESCRIPTION OF DRAWINGS

The detailed drawings presented herein have a variety of incidental structural features omitted in the interest of clarity. Threaded connections, for instance, of manufacturing and maintenance utility, but not bearing on points of novelty, are omitted. Openings that are best sealed to some degree by conventional means are captioned s at least once in similar structure.

Figure 1A:
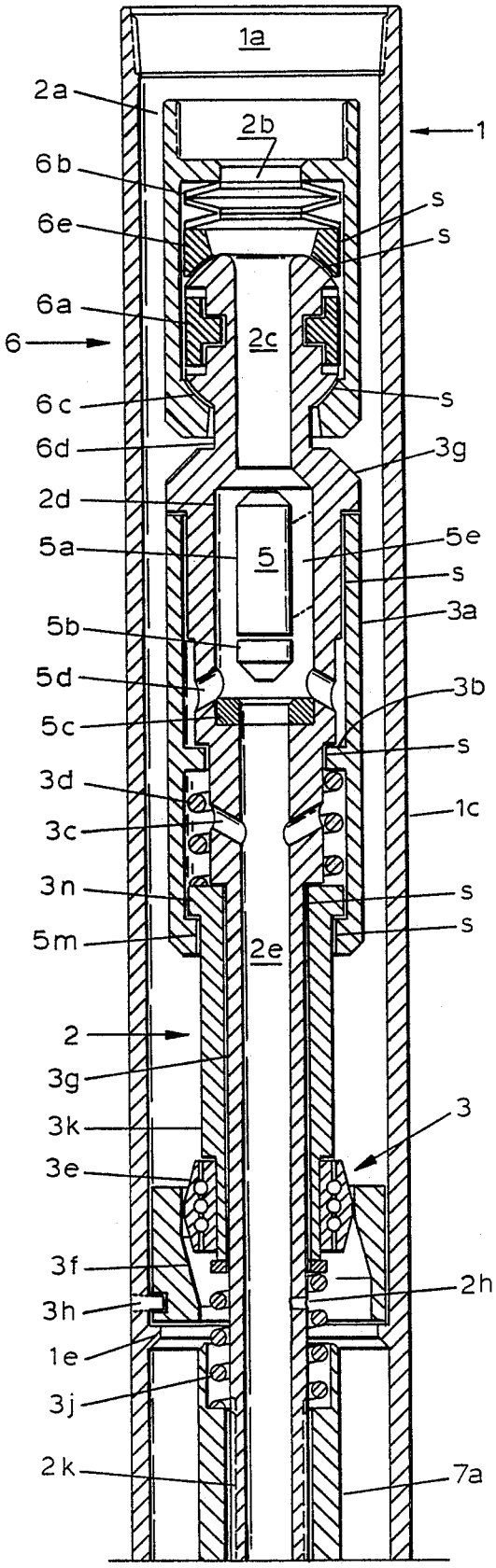
FIGS. 1A and 1B are side elevations, in cutaway, and are mutually continuations with 1A being the top end of the apparatus.
Figure 1B:
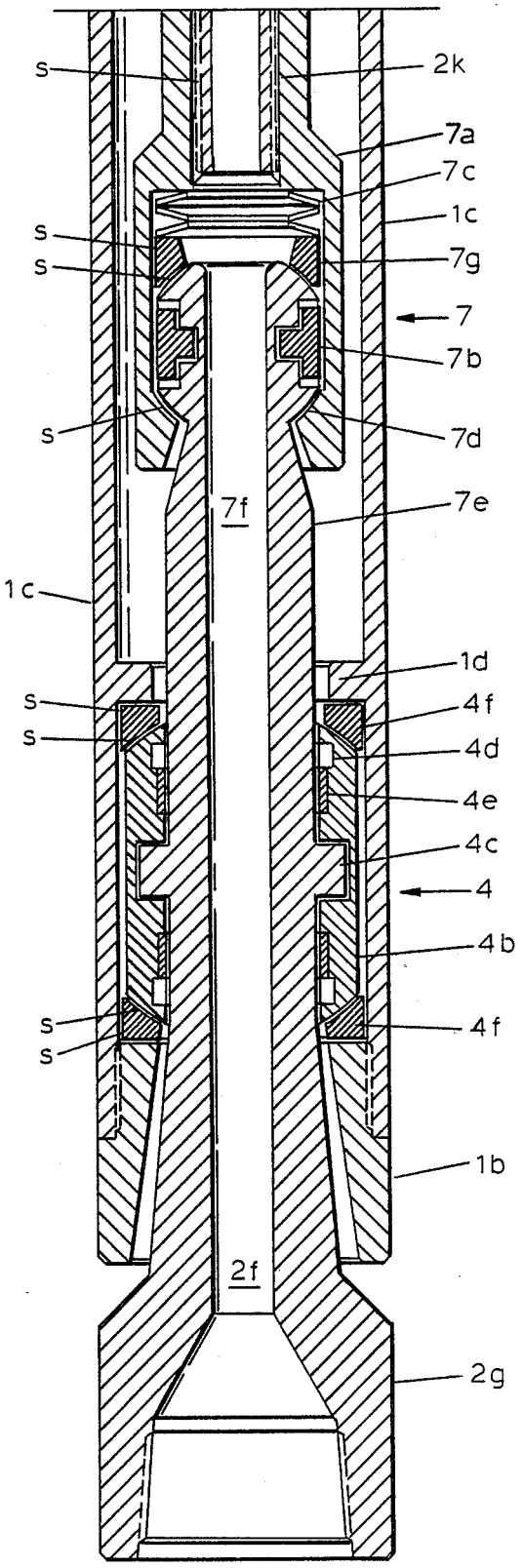

FIGS. 1A and 1B are mutually continuing views of the preferred embodiment in the straight hole drilling configuration. FIG. 1A shows the top end. Body 1 is a generally cylindrical extension of the body of the motor (not shown) to be attached to apparatus of this invention. The attached motor may be a positive displacement motor, a turbodrill motor, or an electrodrill motor. All will hereinafter be referred to as a down hole motor, or motor. When the motor is attached to connector 1*a*, motor and body 1*c* become, in effect, a rigidly associated assembly.

The usual down hole motor, in drilling configuration, will have an output shaft protruding from the motor body, similar to output shaft 2*g* protruding from body 1. In that configuration, drilling fluid leaves the motor through the bore in the output shaft. There will be bearings to support the motor shaft, axially and radially. To connect a motor to the connector 2*a*, the motor shaft is cut back, or initially made that way to fit apparatus of this invention. The motor shaft to be attached to connector 2*a* will still have independent bearing support in the motor and fluid will still flow down the shaft bore into bore 2*b*.

Upper universal joint (u-joint) 6 is sealed to conduct flow through the u-joint bore to bore 2*c*. Cardan coupling 6*a* is situated in an annular groove around the periphery of the ball of ball and socket arrangement 6*c* to rotationally connect connector 2*a* and u-joint output shaft 6*d*. Spring 6*b* loads socket element 6*e* to keep the ball and socket arrangement in sealing engagement.

Mainshaft midsection 3*g* is rotationally coupled to shaft 6*d* and bas opening 2*d* to accommodate and support the Remote Control Selector (RCS) valve 5. Fins 5*e* attach the RCS valve housing 5*a* to shaft 3*g*. At the lower end of opening 2*d*, orifice 5*c* is sealingly situated. Poppet 5*b* can move down to occlude the orifice in response to flow control actions yet to be described. When the poppet is above the orifice, as shown, drilling fluid flows therethrough to channel 2*e*.

In the straight configuration, as shown, shaft 3*g* is rotationally coupled to the motor output shaft (not shown) and rotates on the body centerline. The motor rotates shaft 3*g*, the lower u-joint 7 and output shaft 2*g* through slip joint 2*k*, which is splined.

Lower u-joint 7 is identical to u-joint 6 and has similar spring 7*c* in u-joint body 7*a*, which loads element 7*g* to fluidly seal ball and socket arrangement 7*d*. The Cardan coupling element 7*b* is in a peripheral groove and rotationally couples body 7*a* and shaft 7*e*. Both u-joints permit relative deflection of rotational axes above and below. In the straight configuration shown, the u-joints have no function.

Hinge means 4 is supported in body 1. The hinge means is a ball and socket gimbal containing radial bearings 4*e*, thrust bearing 4*c* and seals 4*d* to permit the shaft 7*e* to rotate therein.

Thrust bearing means 4*c* conveys bit loads and various other axially directed thrust forces to body 1.

Normal drilling fluid pressure stands in ports 5*d* but bias springs 3*d* and 3*j* are strong enough to prevent downward movement of cylinder 3*a* under forces produced by normal drilling fluid pressure. Bias 3*j* opposes downward forces on piston face 3*b*. Vent 2*h* bleeds some fluid from channel 2*e* to maintain pressure in the body enclosure in the event the motor used does not bleed fluid around the motor output shaft into the enclosure. Some motors have such bleeds to cool bearings and some do not and the vent avoids dependency.

Figure 2A:
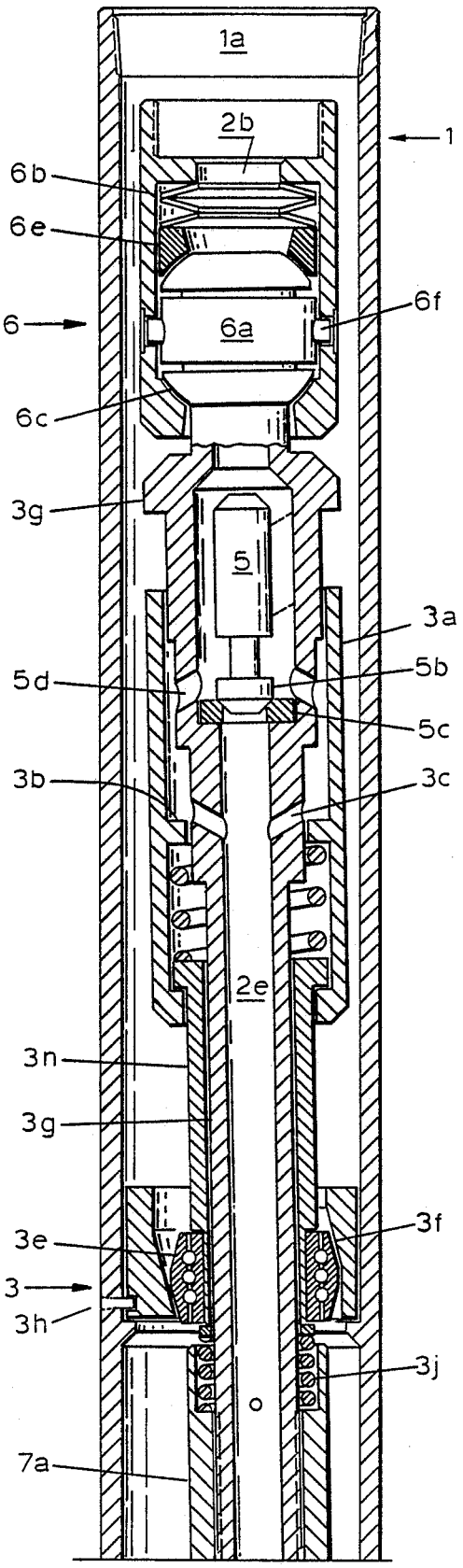
FIG. 2A is a side elevation, mostly cutaway, of the apparatus of FIG. 1A, after the apparatus has been placed in the directional drilling configuration.
Figure 2B:
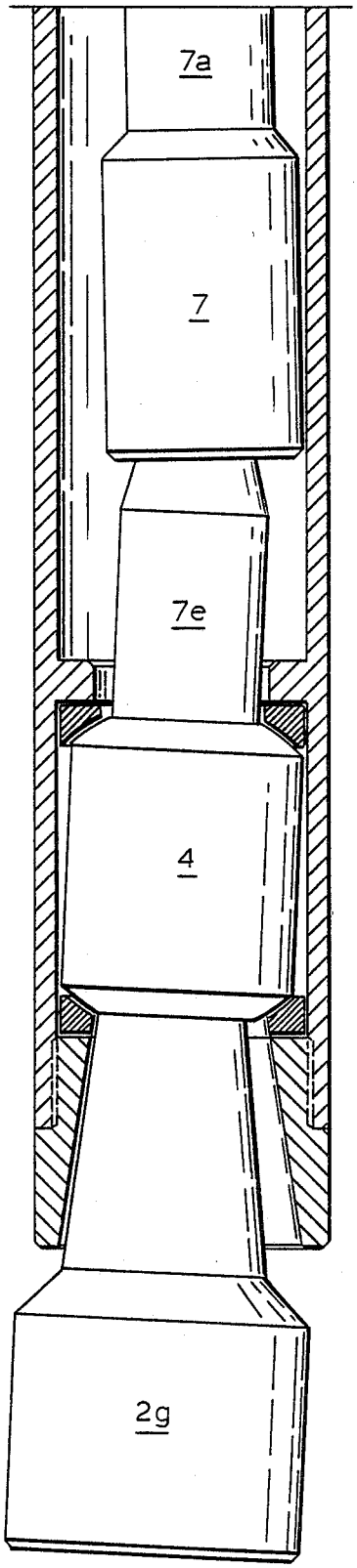
FIG. 2B is a side elevation, partly cut away, of the apparatus of FIG. 1B. The rotating parts are not cut away to more clearly show the relationships of principal elements.

FIGS. 2A and ZB show the apparatus of FIGS. 1A and 1B with the shaft deflected to the directional drilling configuration.

RCS valve 5 responds to manipulations of the drilling fluid flow rate, exercised at the earth surface, to control the position of poppet 5*b* when fluid flows past the poppet. For straight configuration, the poppet is retained above the orifice as shown in FIG. 1A. For directional configuration shown, the poppet is allowed to move down to occlude the orifice 5*c*.

By preference, when drilling fluid flow is first initiated, the poppet stays open. When drilling fluid flow is reduced below a preselected amount, or stopped, then restarted, poppet 5*b* will be allowed to move down to close the orifice. Should the fluid flow again be reduced, or stopped, the RCS valve will react and shift back to straight configuration, and the cycle of choices can be endlessly repeated.

In FIG. 2A the directional configuration has been chosen by processes described above, and the poppet has closed the orifice. Fluid flowing down channel 2c is forced through ports 5d. The fluid pressure imposed on piston area 3b has moved cylinder 3a downward until fluid can flow through by-pass ports 3c back to channel 2e. The fluid will flow as before to and through output shaft 2g and to the downwardly continuing drill string, which may include only a drill bit.

When cylinder 3a moved downward, the deflector bearing 3e was thrust into the eccentric bore of deflector block 3f. Radial movement of driveshaft 3g is accepted by both upper and lower u-joints. The lower u-joint 7 and the gimbal 4 are both on rigid shaft 7e and the axis of shaft 7e is caused to deflect and cross the body general centerline at the center of the gimbal. The gimbal becomes a hinge means because the skewed bore of deflector block 3f has a fixed radial relationship with a radial line of the body, defined by index pin 3h. This causes the rotational axis of shaft 7e and output shaft 2g to lie in a particular plane containing the body centerline. The hinge rotational axis then has a rotational relationship to the index pin and makes the system subject to rotational orientation by way of rotationally orienting the drill string relative to earth.

Otherwise stated, to relate structure and function, a deflection enabling means provides rotational and axial support for output shaft 2g and provides means to pivot the rotational centerline of the output shaft about a line perpendicular to both the body centerline and the rotational centerline of the output shaft. The deflection enabling means is the gimbal defined as hinge means 4 and the cooperating, body mounted, mating parts 4f.

Actuating means to compel deflection enabled by the hinge means comprises deflector bearing 3e and the slanted, body mounted, bore in deflector block 3f, as well as the forcing piston 3b and related thrusting elements 3a and 3k.

Rotational orientation of the drill string is conventionally practiced by those skilled in the art, using available down hole instruments.

With the output shaft 2g deflected from the motor general centerline, the output shaft and a drill head attached thereto will produce a hole that will progress along a curved line until the amount of planned departure from the original direction is achieved. If the ease of configuration change from straight hole to directional and back is realized, the amount of deflection of the output shaft need only be about two degrees.

The function of spring 3d is to allow cylinder 3a to move down under the influence of the rather powerful drilling fluid hydraulic system without damaging machine elements if the output shaft and drill head should be jammed. Jamming can result from many causes. Jamming can usually be cleared up and drilling can proceed if the machinery is undamaged.

Slip joint 2k allows the driveshaft assembly to be lifted up above the body to connect 2a to a motor shaft before the body connections are made. That feature is a convenience but the absence of some travel in the slip joint would make precision a requirement to avoid conflicts between motor bearings and the bearings in gimbal 4.

Spring 3j urges the cylinder 3a upward. The arrangement shown causes the thrust of spring 3j to act downward on u-joint 7. It is sometimes preferable to transfer the thrust of spring 3j to the bearings of the motor driving the apparatus. A collar is placed around shaft 3g to support the lower end of spring 3j, above the slip joint 2k. By supporting the spring 3j on the motor bearings, the unit loads between ball and socket mating surfaces 7d remain constant whether straight hole drilling or directional drilling.

Figure 3:
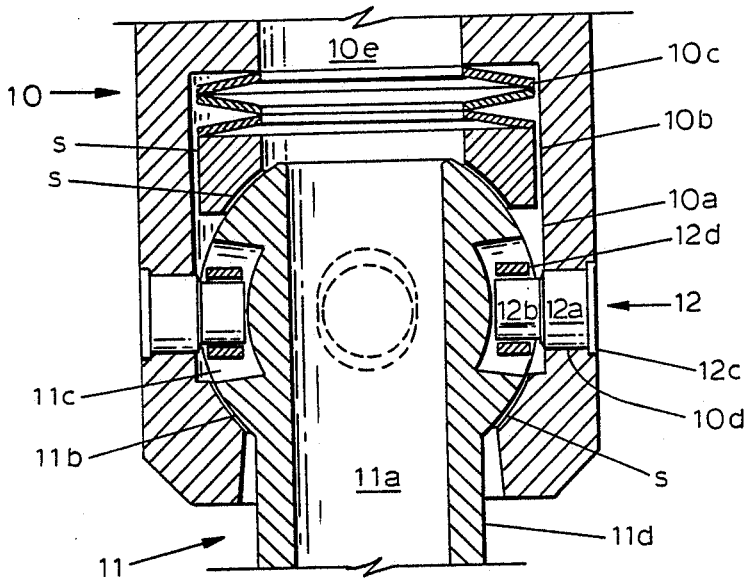
FIG. 3B is a side elevation, mostly cut away, of an alternate embodiment of universal joints usable in the tools of this invention.

FIG. 3 represents an alternate embodiment of a u-joint usable for either or both u-joints 6 and 7 of FIGS. 1A and 1B.

Connector body 10 has threads (not shown) for attachment to a motor output shaft as hereinbefore described. Opening 10a accommodates ball loading socket element 10b, driven against the ball surface by spring 10c.

There are, preferably, four drive pins 12 at 90 degrees apart. Shanks 12a are pressed into bores 10d, limited by the flanges 12c. Studs 12b extend radially inward and support cam rollers 12d in arcuate slots 11c. Driven shaft 11d extends as previously described to elements below.

Drilling fluid flows through bores 10e and 11a. Seals are captioned s and are not detailed because they are well established in the art and are not points of novelty. O-ring seals are preferred for element 10b but the ball and socket rubbing surfaces appear to provide the degree of sealing needed. The various spaces between the body 10 and element 11 are first evacuated and then grease filled. The time related dilution of grease is offset,in effect, by continuous lubrication of all ball and socket rubbing surfaces. O-rings can be used to seal the ball and socket rubbing surfaces, if necessary, in conventional fashion.

A first drilling fluid channel includes bores 2b and 2c, opening 2d orifice 5c. channels 2e, 7f and 2f

A second drilling fluid channel includes bores 2b and 2c, opening 2d, ports 5d and the bore of cylinder 3a.

A third drilling fluid channel includes by-pass ports 3c, channels 2e, 7f and 2f.

Hydraulic cylinder 3a, deflection bearing 3e and deflector block 3f comprise an actuator means to provide deflecting forces to a deflector control means comprising hinge means 4, shaft 7e and body 1c. Body 1c effectively supports the fulcrum (ball and socket 4) enabling lateral forces to produce angular deflection of the rotational axis of the output shaft 2g.

The actuator system responds to signals from the RCS valve, one signal consisting of low pressure across orifice 5c, and another signal consisting of high pressure across the orifice.

It should be recognized that the apparatus of this invention is currently most usable on drilling motors already in existence, but this is a market condition and not a technical limitation or preference. Motors especially made for operation with features of this invention may not necessarily be sealed and bearing supported independently of the apparatus. A motor rotor may stand on the drive shaft of this apparatus and depend upon the seals at the gimbal. Similarly, the drive shaft of the apparatus of this invention may well be suspended from the thrust bearings of the motor and may not have independent seals or thrust bearings. The claims anticipate such arrangements and embody the motor as part of the structure.

Some of the challenging and complex features, such as seals and bearings in gimballed situations should be regarded as symbolic and simplified. Such bearings and seals are subjects of considerable research and development effort widespread in the industry. Simple versions shown will work as described but extending the life is the challenge. To ideally utilize the powerful downhole drilling motors available, the entire down hole assembly should last as long as the drill head, or bit. Bit life has been extended so much that the related machinery is challenged.

The gimbal disclosed herein, forming a hinge means when used with an oriented deflection means, is necessarily limited in geometric size relative to seals and bearings. It should not be construed that the seals and bearings are confined to the ball interior. The bearings and seals may be in extended structure associated with the ball.

Figure 4:
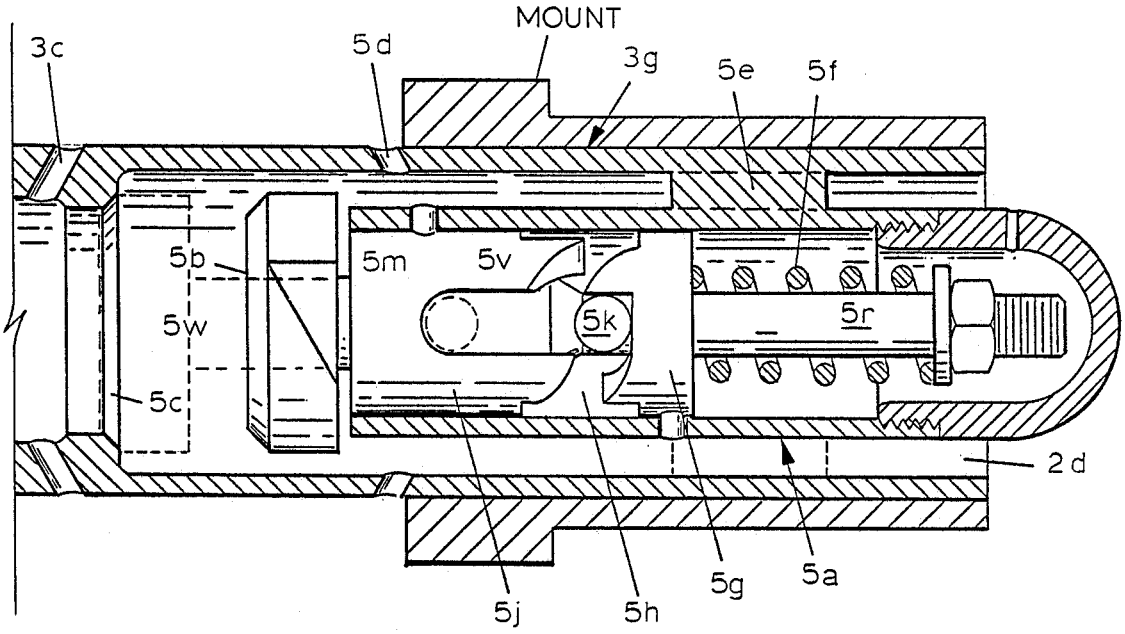
FIG. 4 is a side view, mostly cut away, of the Remote Control Selector Valve portion of the apparatus of the invention. This view is rather enlarged.

FIG. 4 represents the Remote Control Selector (RCS) Valve 5 of FIG. 1. This valve responds to changes in the rate of drilling fluid flow to change downhole configuration of the tool. The block labelled "mount" is part of the structure 3*g* in one adaptation of FIG. 1.

When drilling fluid flow rate is below a certain amount, poppet 5*b* is in the position shown, urged there by spring 5*f*. When fluid flows through bore 2*d*, past mount fins 5*e* and through orifice 5*c*, it tends to entrain poppet 5*b* and move it leftward to overcome spring 5*f* and occlude the orifice. Turbine surface 5*w* tends to rotate the poppet clockwise viewed from the orifice. If the poppet is allowed to close the orifice, drilling fluid pressure will be diverted through ports 5*d* and cause deflection of the tool by processes already described herein.

Poppet 5*b* will move to occlude the orifice 5*c* only on alternate occasions of increase of drilling fluid flow rate from less than a preselected smaller amount more than a preselected larger amount. On other occasions of such flow rate increases, the poppet is stopped before reaching the orifice. The control is carried out by structure best understood with FIG. 5 in view.

Figure 5:
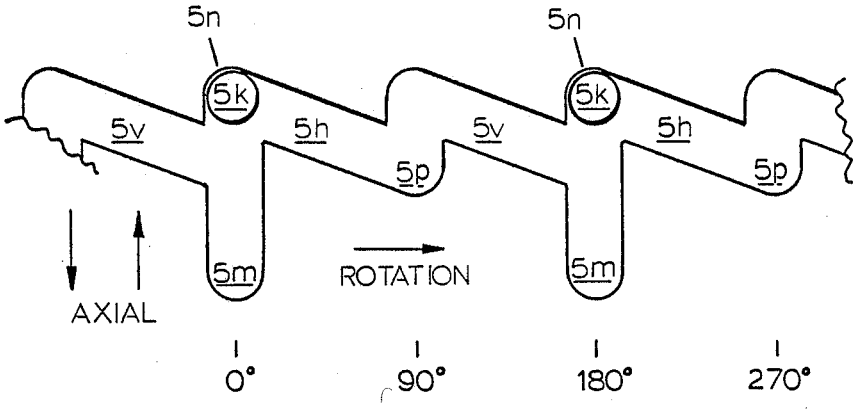
FIG. 5 is a development of selected surfaces of the valve control of FIG. 4.

FIG. 5 is a surface development of grooves produced by space between cams 5*g* and 5*j*, viewed toward the centerline. Crosshead pins 5*k*, poppet 5*b* are one structural element and move in unison. The tendency of poppet 5*b* to rotate when it moves leftward causes pins 5*k* (of FIG. 5) to move from the region 5*n* along groove 5*h* when fluid flow increases. On the first occasion of flow rate increase (assuming the starting situation shown), pin 5*k* goes to region 5*p* where it was arrested, and the poppet cannot occlude the orifice. When the fluid flow rate is sufficiently decreased, pins 5*k* will be urged to region 5*q* by spring 5*f*. On the next occasion of flow rate increase, the pins will move from 5*q* along groove 5*v* and into region 5*m*. This allows the poppet to occlude the orifice and the tool will be deflected as previously described herein.

In response to each increase in the fluid flow rate, between preselected limits, as described above, the poppet moves downstream and this motion is an output signal. If the poppet is stopped before reaching the orifice, this is a first signal and results in an open state of the orifice and a straight configuration of the tool. If the poppet is allowed to move to and occlude the orifice, this is a second output signal that results in a closed state of the orifice and a deflected tool configuration.

The driller can change the downhole configuration of the tool from one choice to another by exactly the same mud pump throttle manipulations. The mud flow rate manipulation then that changes to a specific configuration is assigned a characteristic that depends upon the configuration existing at the time the election to change is made. If the tool is deflected, the next flow rate manipulation that causes change downhole has a first characteristic. If the tool is in the straight configuration, the next flow rate manipulation that causes change downhole has a second characteristic.

The simple selector valve preferred has only two phases which permit endless changes between two states. By changing the nature of the grooves any number of phases could be chosen and any series of states (orifices closed or open) could be programmed. The assigned characteristic for each mud flow manipulation would correspond to the phase choices available.

From the foregoing, it will be seen that this invention is one well adapted to attain all of the ends and objects hereinabove set forth, together with other advantages which are obvious and which are inherent to the method and apparatus It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

We claim:

1. An extension for a down hole drilling motor to adapt the motor for selective configuration for straight hole drilling or directional drilling, selectively, the apparatus comprising:

(a) an elongated generally tubular body, adapted at a first end to rigidly attach to the lower end of a down hole drilling motor housing, said body having an opening extending along the general centerline of said body;

(b) fluid channel means situated in said copening to conduct drilling fluid from said motor fluid output means to a downwardly continuing drill string element;

(c) output shaft means situated in said body and extending from a second end of said body, said output shaft adapted at the extended extreme for attachment to a downwardly continuing drill string element;

(d) deflection enabling means mounted in said body near said second end operatively associated with said output shaft and adapted to axially support said output shaft for rotation, and operatively associated with said body to permit change of the direction, relative to the body general centerline, of the axis of rotation of said output shaft;

(e) selector valve means situated in said body, operatively associated with drilling fluid channels in said body, responsive to drilling fluid flow to produce a first output signal in response to fluid flow manipulations having a first characteristic and to produce a second output signal in response to fluid flow manipulations having a second characteristic;

(f) actuator means situated in said body, operatively associated with said deflector means, responsive to said first signal to cause the rotational axis of said output shaft to be generally coincidental with the extended centerline of said body and responsive to said second signal to cause said rotational axis of said output shaft to be deflected from the extended body centerline;

(g) driveshaft connector means in said opening, operatively associated with the output shaft of said motor and said output shaft means to connect the two for sympathetic rotation.

2. The apparatus of claim 1 further providing that said deflector means comprise a ball and socket gimbal, said socket being secured to said body, said ball situated in said socket, said ball operatively associated with structure containing bearings to support said output shaft axially for rotation.

3. The apparatus of claim 2 further providing that said ball be non-rotational about the body centerline and that said output shaft rotate relative to said ball.

4. The apparatus of claim 1 further providing that said actuator means comprise a hydraulic cylinder, responsive to drilling fluid pressure to urge said output shaft to deflect laterally relative to the general centerline of said body.

5. The apparatus of claim 1 further providing that said driveshaft connector means be tubular arranged to conduct drilling fluid from the drilling motor output shaft bore to a bore through said output shaft means.

6. The apparatus of claim 5 further providing that said actuator means comprise a hydraulic cylinder mounted on said driveshaft connector means, responsive to drilling fluid pressure controlled by said selector valve means.

7. The apparatus of claim 1 further providing a tubular driveshaft connector means arranged to conduct drilling fluid from the output of the drilling motor to said output shaft means, further providing mounting in the bore of said connector means for said selector valve means.

8. The apparatus of claim 7 further providing said actuator means comprise a hydraulic cylinder disposed axially along said driveshaft connector means, situated to extend in the axial direction of said connector means, said cylinder situated to relatively move two opposed surfaces, one of which is structurally associated with said body, said two surfaces arranged to cause said connector means to move laterally relative to said body centerline to cause the deflection of said output shaft means.

9. The apparatus of claim 7 further providing a universal joint means near each end of said connector means, said universal joints sealed for fluid flow therethrough.

10. The apparatus of claim 1 wherein a first fluid channel extends axially through a bore in said driveshaft connector means, said selector valve means is situated to produce said second signal by inhibiting flow through said first channel, a hydraulic cylinder disposed axially along said driveshaft connector means responds to pressure differential across said selector valve to relatively move two opposed surfaces arranged to force said connector means to move laterally relative to said body when so moved, said cylinder operatively associated with means to by-pass fluid around said selector valve after moving some distance in response to said pressure differential.

11. A combination down hole drilling motor and final output driveshaft deflector means for controlling the deflection of the centerline of a hole being drilled, the apparatus comprising:

(a) a body comprising a length of drill string with a generally central opening extending axially therein and provided with means at a first end to attach to an upwardly continuing drill string;

(b) a down hole drilling motor situated in said opening, toward said first end, mounted for axial support and rotation therein, with means to conduct drilling fluid from the upwardly continuing drill string to said opening below said motor;

(c) output shaft means situated in said body and extending from a second end of said body, said output shaft adapted at the extended extreme for attachment to a downwardly continuing drill string element;

(d) deflection enabling means mounted in said body near said second end operatively associated with said output shaft and adapted to axially support said output shaft for rotation, and operatively associated with said body to permit change of the direction, relative to the body general centerline, of the axis of rotation of said output shaft;

(e) selector valve means situated in said body, operatively associated with drilling fluid channels in said body, responsive to drilling fluid flow to produce a first output signal in response to fluid flow manipulations having a first characteristic and to produce a second output signal in response to fluid flow manipulations having a second characteristic;

(f) actuator means situated in said body, operatively associated with said deflector means, responsive to said first signal to cause the rotational axis of said output shaft to be generally coincidental with the extended centerline of said body and responsive to said second signal to cause said rotational axis of said output shaft to be deflected from the extended body centerline;

(g) driveshaft connector means in said opening, operatively associated with the output shaft of said motor and said output shaft means to connect the two for sympathetic rotation.

12. The apparatus of claim 11 further providing that said deflector means comprise a ball and socket gimbal, said socket being secured to said body, said ball situated in said socket, said ball operatively associated with structure containing bearings to support said output shaft axially for rotation.

13. The apparatus of claim 12 further providing that said ball be non-rotational about the body centerline and that said output shaft rotate relative to said ball.

14. The apparatus of claim 11 further providing that said actuator means comprise a hydraulic cylinder, responsive to drilling fluid pressure to urge said output shaft to deflect laterally relative to the general centerline of said body.

15. The apparatus of claim 11 further providing that said driveshaft connector means be tubular arranged to conduct drilling fluid from the drilling motor output shaft bore to a bore through said output shaft means.

16. The apparatus of claim 15 further providing that said actuator means comprise a hydraulic cylinder mounted on said driveshaft connector means, responsive to drilling fluid pressure controlled by said selector valve means.

17. The apparatus of claim 11 further providing a tubular driveshaft connector means arranged to conduct drilling fluid from the output of the drilling motor to said output shaft means, further providing mounting in the bore of said connector means for said selector valve means.

18. The apparatus of claim 17 further providing said actuator means comprise a hydraulic cylinder disposed axially along said driveshaft connector means, situated to extend in the axial direction of said connector means, said cylinder situated to relatively move two opposed surfaces, one of which is structurally associated with said body, said two surfaces arranged to cause said connector means to move laterally relative to said body centerline to cause the deflection of said output shaft means.

19. The apparatus of claim 17 further providing a universal joint means near each end of said connector means, said universal joints sealed for fluid flow therethrough.

20. The apparatus of claim 11 wherein a first fluid channel extends axially through a bore in said driveshaft connector means, said selector valve means is situated to produce said second signal by inhibiting flow through said first channel, a hydraulic cylinder disposed axially along said driveshaft connector means responds to pressure differential across said selector valve to relatively move two opposed surfaces arranged to force said connector means to move laterally relative to said body when so moved, said cylinder operatively associated with means to by-pass fluid around said selector valve after moving some distance in response to said pressure differential.

21. A down hole drilling motor with means to deflect the rotational centerline of the output shaft from the motor general centerline, the apparatus comprising: a down hole drilling motor; a rigid final output drive shaft extending from the motor body and adapted to connect to an element of a downwardly continuing drill string, and flexibly connected for rotation to the motor drive means; a fulcrum means situated in said body arranged to rotationally support said final output drive shaft and operationally associated with said body to pivot some amount relative to said body centerline; a remote control selector valve situated in said body, responsive to the flow of drilling fluid through said body to produce a first output signal in response to drilling fluid flow manipulations of a first characteristic and responsive to drilling fluid flow manipulations of a second characteristic to produce a second output signal; lateral force means operatively associated with said fulcrum means, responsive to said second signal to apply lateral forces to said fulcrum means to cause said output drive shaft to be deflected from said body general centerline; bias means situated to urge said fulcrum means to align said output drive shaft with said body general centerline; and fluid channel means arranged to conduct drilling fluid from the upper end of said motor body to and through said final output drive shaft to the downwardly continuing drill string.

* * * * *